United States Patent [19]

Burger

[11] Patent Number: 5,005,821

[45] Date of Patent: Apr. 9, 1991

[54] LOOSE ELEMENT SHEET STACKING ASSISTANCE SYSTEM

[75] Inventor: William R. Burger, Fairport, N.Y.

[73] Assignee: Xerox Corporation, Stamford, Conn.

[21] Appl. No.: 517,797

[22] Filed: May 2, 1990

[51] Int. Cl.[5] ..... B65H 31/28

[52] U.S. Cl. ..... 271/198; 271/224; 271/110; 271/293; 271/294; 271/301; 271/902; 271/119

[58] Field of Search ..... 271/224, 220, 198, 178, 271/186, 18.3

[56] References Cited

U.S. PATENT DOCUMENTS

| | | | |
|---|---|---|---|
| Re. 30,084 | 8/1979 | Morton | 271/18.3 X |
| 2,995,366 | 8/1961 | Maidment | 271/224 X |
| 3,460,825 | 8/1969 | Mets et al. | 270/61 |
| 3,847,388 | 11/1974 | Lynch | 271/174 |
| 4,385,758 | 5/1983 | Ellsworth | 271/224 |
| 4,782,363 | 11/1988 | Britt et al. | 355/14 |
| 4,883,265 | 11/1989 | Iida et al. | 271/220 |

*Primary Examiner*—Richard A. Schacher

[57] ABSTRACT

In a sheet stacking system, especially for a printer or copier set complier, in which sheets are sequentially fed for stacking into a stacking tray to a stacking registration wall position, a sheet stacking assistance and control system is provided by partially supporting and rotating an endless weighted chain-like lose element member, e.g., a metal bead chain, from above the stacking tray, preferably by two spaced and commonly driven pulleys, so that a first chain portion continuously moves downwardly towards the stacking tray in the path of said sheets being fed in the stacking tray to help pull them down, and then the chain flexes so that a substantial second chain portion continuously lies on the top sheet being stacked and continuously drags it towards the registration position, and then desirably an immediately following third chain section is pulled through the registration wall and sharply arcuately dropped there below the stack top level to continuously drag down the sheet edges there. This device has the ability to accommodate a wide range of stack heights and the ability to compile large stacks without requiring adjustment of the complier tray.

12 Claims, 1 Drawing Sheet

LOOSE ELEMENT SHEET STACKING ASSISTANCE SYSTEM

Figure 1:
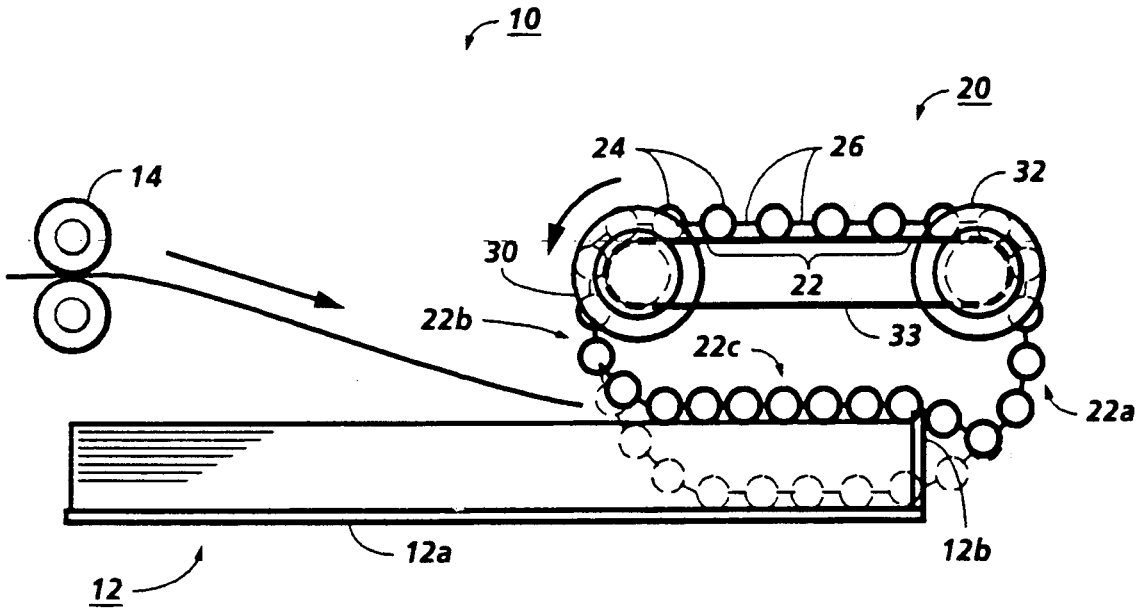

The present invention relates to a sheet stacking assistance and/or control system for improved physical control of sheets of printed copy paper or other such flimsy and delicate sheets being stacked, or for restacking of original documents after being copied. The stacking control assistance or system disclosed herein may be utilized in the sheet output of various printers or copiers or the like, in output stacking bins or trays, sorter or collator bins or trays, and the like.

Copiers and printers commonly have thermal roller image fusers which tend to induce curl in their copy sheet output, and may also have electrostatic charges on the sheets, aggravating their output stacking problems. Yet they also often need to provide immediate on-line binding or finishing of copy sets.

The disclosed system is particularly desirable for a compiler for a finisher. In a compiler tray or area a stack of sheets must be closely stacked and aligned for stapling, gluing or other binding or finishing operations, as is well know per se, as noted, e.g., in the patents cited in U.S. Pat. No. 4,782,363 (D/87203) at Col. 13 lines 1–27, inter alia.

Disclosed herein is an improved and low cost stacking assistance system in which positive but controlled force feeding assistance of sheets to be stacked towards a registration or set alignment wall is provided. Also provided is positive but controlled force pulling down of otherwise curled up edges of sheets being stacked. In the disclosed system this edge stacking hold-down assistance may be desirably provided directly at the sheet stack edge being registered, and reduce the tendency for a stack to climb up against the edge registration or set alignment wall, especially with curled edge sheets. As shown in the disclosed embodiment, this may be provided by a simple and low cost system utilizing an endless driven lose (highly flexible) irregular and weighted element chain-like member, such an endless metal bead chain. Preferably it is driven through the registration or set alignment wall, using plural supporting members at opposite sides thereof, to drag across the top sheet of the stack towards that wall and then drop down below the stack edge.

In many sheet stacking processes it is desirable to be able to stack from two sheets up to a large number of sheets in sets with very close stack registration dimensions, e.g., with all sheets in a set aligned to within a fraction of a millimeter on at least one edge, to avoid ragged or uneven looking stack edges in finished sets. It is also desirable to be able to stack and register sheets rapidly, in the time available between sequentially fed sheets. It is also desirable to be able to do so with a relatively simple and low cost apparatus, yet with high reliability, absence of document edge damage or image smearing or operator danger, and accommodating a wide range of paper sheet sizes and weights and/or stiffnesses. It is also desirable to be able to accommodated a wide range of stack heights and to be able to compile large sets or stacks of sheets (e.g., up to 250 or more sheets) without requiring adjustment of the compiler position relative to the stack or tray. Traditionally, sheet stacking systems have relied primarily on gravity and the momentum or inertia of each sheet as it is ejected into over over the stacking tray by the feed rollers or other ejecting system. However, more positive stacking by sheet knockdown assistance and sheet edge registration assistance has become even more desirable, especially for compiling.

By way of background, various paddle wheel or other scuffer type compiler or other stacking assistance systems are known in the art, e.g., Xerox Corporation U.S. Pat. No. 3,847,388 issued Nov. 12, 1974 to T. Lynch. Particularly noted is the driven flexible or floppy endless belt sheet aligning web member 50 disclosed in Canon U.S. Pat. No. 4,883,265 issued Nov. 28, 1989 to N. Iida, et al. Although in successful commercial use, that system has some significant disadvantages overcome by the present system. For example, even though that belt 50 is disclosed in an uphill tray stacking system (which provides somewhat more latitude or capacity than a generally horizontal tray), when a large number of sheets have been stacked, the belt 50 can become unstable and deflect or buckle laterally to one side, and also change its operating position on top of the stack. Furthermore, although this Canon belt 50 is partially flexible it is relatively stiff, and always convex in shape, and thus does not extend to and directly overly and press down the very end of the stack edge, nor can it drop down below the stack edge. Also, the belt 50 has teeth on its inside rather than on the outside and thus they cannot engage the sheets. Also, the belt 50 has essentially only a single point or nip 52/53 drive and control.

By way of background as to the use of bead chains per se in stacking systems in general, there are examples in the art of passive, undriven, vertically hanging bead chains against which incoming sheets or computer form webs are impacted or fed for stacking assistance, e.g., U.S. Pat. Nos. 4,385,758 to Ellsworth or 3,460,825 to Mets et al.

Further by way of background, there is a long well known problem in copiers or printers with overstacking, or not providing for a sheet stacking capacity limit. As an overstacked condition is reached, the copy or print sheets on top of the stack can be mislocated. That is, by building a stack set too high relative to the sheet input or entrance level, additional entering sheets can push previous sheets off of the top of the stack. Particularly in a stacking system which provides offsetting or lateral offsetting into job sub-sets of the sheets being stacked, overfilling the tray and then continuing to attempt to feed in more sheets can cause sheet drag induced skewing of the previously stacked sheets and disturb the job subset integrity. Overstacking can also cause jams and/or curls of incoming sheets by dragging or catching the lead edge of the incoming sheet on the top of the stack, or other such problems. Such overfill conditions can be reached long before the actual overfilling of the intended stacking tray capacity if the edges of incoming sheets are curled up against a stacking edge or wall and not being pushed down. The sheets can misfeed over the top of this wall.

By way of an example of sheet corrugation stacking assistance, which may be additionally utilized in combination herewith if desired, there is U.S. Pat. No. 4,469,319 issued Sept. 4, 1984, to Frank Robb, et al. Sheet trail edge flexible knockdown assistance flaps for sheet restacking control are disclosed in this U.S. Pat. No. 4,469,319, and also in U.S. Pat. No. 4,789,150 issued Dec. 6, 1988 to M. Plain. These patents are assigned to Xerox Corporation.

A specific feature of the specific embodiment disclosed herein is to provide a sheet stacking apparatus for a printer or copier in which sheets are sequentially fed by sheet output means into a stacking tray and against a stacking registration wall for stacking with a sheet stacking assistance and control system; the improvement in said sheet stacking assistance and control system comprising an endless chain-like lose element member, a supporting means providing for endless rotation of said chain-like lose element member, said supporting means for partially supporting said endless chain-like lose element member above said stacking tray so that a first integral portion of said endless chain-like lose element member hangs downwardly from said supporting means towards said stacking tray in the path of said sheets being sequentially fed by said sheet output means, and so that a second integral portion of said endless chain-like lose element member lies on top of any sheets stacking in said stacking tray, and a driving means for endless rotation of said chain-like lose element member so that continuously said first portion of said chain-like lose element member is moving downwardly towards said stacking tray, and said second portion of said chain-like lose element member is being dragged over the top of any sheets stacking in said tray to drag the top sheet towards said stacking registration wall.

Further specific features provided by the system disclosed herein, individually or in combination, include those wherein said supporting means for supporting said endless chain-like lose element member above said stacking tray comprises two chain supporting members spaced at opposite sides of said stacking registration wall, and/or wherein said stacking tray is a copy set compiler tray, and/or wherein said endless chain-like lose element member has a third integral portion dropping below one top edge of any sheets stacking in said stacking tray, and/or wherein said endless chain-like lose element member has a third integral convex portion dropping below one edge of sheets stacking in said stacking tray at said stacking registration wall and wherein said endless chain-like lose element member has a third integral portion extending through an aperture in said stacking registration wall, and/or wherein said endless chain-like lose element member has a third integral portion extending through an aperture in said stacking registration wall and dropping below the top level of one edge of any sheets stacking in said stacking tray to pull down said sheet edge and/or wherein said first second and third integral portions are directly sequential portions of the length of said endless chain-like lose element member hanging from said two chain supporting members, and/or wherein said endless chain-like lose element member is a bead chain of multiple weighted and generally smoothly arcuately surfaced bead elements interconnected and spaced apart by highly flexible interconnecting elements of much smaller effective diameter, so as to provide concentrated and intermittent contact of said bead elements with sheets stacking in said stacking tray.

Further disclosed features include a method of sheet stacking in which flimsy sheets are sequentially fed into a stacking tray to a stacking registration position for stacking with a sheet stacking assistance and control system; the improvement in said sheet stacking assistance and control system comprising a partially supporting and rotating an endless chain-like lose element member from above the stacking tray so that a first integral portion of said endless chain-like lose element member continuously moves downwardly from said supporting means towards said stacking tray in the path of said sheets being sequentially fed into the stacking tray to help pull them down towards the stacking tray, and so that a substantial second integral portion of said endless chain-like lose element member continuously lies on top of any sheets stacking in said stacking tray and drags them towards the stacking registration position, and wherein said chain-like lose element member freely flexes in moving from said first to said second integral portions with said rotation, and/or wherein said endless chain-like lose element member is pulled through the stacking registration position and dropped below the top level of any sheets stacking in said stacking tray closely adjacent to said stacking registration position to drag down the edges of any sheets there and/or wherein said endless chain-like lose element member is a bead chain of multiple weighted and generally smoothly arcuately surfaced bead elements interconnected and spaced apart by highly flexible interconnecting elements of much smaller effective diameter to provide concentrated and intermittent contact of said bead elements with sheets stacking in said stacking tray.

All references cited in this specification, and their references, are incorporated by reference herein where appropriate for appropriate teachings of additional or alternative details, features, and/or technical background.

Figure 2:
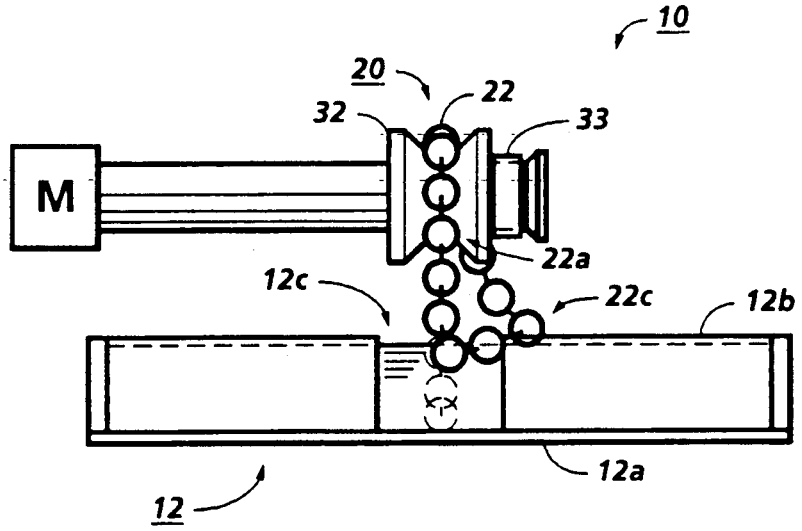

Various of the above-mentioned and further features and advantages will be apparent from the specific apparatus and its operation described in the example below, as well as the claims. Thus the present invention will be better understood from this description of an embodiment thereof, including the drawing figures (approximately to scale) wherein:

FIG. 1 is a schematic side view of one embodiment of an exemplary stacking compiler tray incorporating an example of the subject ball or bead chain stacking assistance and control system, and FIG. 2 is an end view of the system of FIG. 1.

Describing now in further detail the exemplary embodiment with reference to the Figures, there is shown a sheet stacking assistance and control system 10, in which sheets are being stacked in a tray 12 with the assistance of a bead chain stacking assistance system 20. Since the subject sheet stacking assistance and control system 10 may be utilized with almost any conventional or other copier or printer or the like in which conventional cut sheet paper output is being accumulated or stacked in a tray or bin, only the actual stacking area need be illustrated here. Likewise, the set stapler or other known finisher mechanism, and finished set ejecting mechanism, which would be conventionally associated with the use of the tray 12 as a compiler, need not be shown here. Also, although the particular tray 12 shown has a generally horizontal bottom surface 12*a*, it will be appreciated that an uphill tray stacking system may also be utilized.

The sheets here are being sequentially fed into the upstream end of the tray 12 by conventional feed-in rollers 14 to be stacked on top of one another on the tray bottom 12*a*, but also registered or edge aligned against a rear wall or stacking edge guide wall 12*b* of the tray 12. (As is well known, this registration wall 12*b* can be formed by plural upstanding fingers or the like rather than a contiguous vertical surface.)

The exemplary bead chain stacking assistance system 20 here comprises a continuous (endless) chain 22 of balls or beads 24 and their effectively loosely (freely flexible) interconnecting elements 26. This highly flexible and irregular diameter and weighted chain 22, is supported at two separate spaced positions above the tray 12 provided by pulleys 30 and 32. One pulley 30 is positioned upstream part way out over the tray 12 area as shown, and the other pulley 32 is positioned above but downstream of wall 12*b*. Thus, the two pulleys 30 and 32 are respectively fixed at opposite sides of the registration wall 12*b*. The distance of the pulleys 30 and 32 above the tray bottom 12*a* and the length of the chain 22 is preset so that a substantial portion of the chain 22 will drag across a substantial portion of the top sheet of the stack of sheets in the tray 12, no matter how few sheets or how many sheets are in the tray 12 (up to the preset maximum stacking capacity of the tray 12). Here both of the pulleys 30 and 32 are continuously commonly driven by an interconnecting timing belt 33, so as to drag the chain 22 across the top of the stack of sheets towards the registration wall 12*b*. (Alternatively, the downstream pulley 32 could be an idler or even a fixed arcuate low friction guide if the chain 22 path of the linear top bight therebetween were supported in a low friction track, tube or race).

The registration or rear stack stop wall 12*b* here is notched from top to bottom at 12*c* to allow the chain 22 to be directly driven uninteruptedly and linearly right up to and then past the edge of the stack through the wall 12*b*. There, the lose inter-connections 26 of the ball elements 24 allows them to drop down below the stack top edge by their own weight. The chain elements 24 are much more sectionally independent and heavier that a normal belt. Thus this portion 22*a* of the chain 22 can actually assume a concave rather than convex configuration. Thus the chain 22 bead elements 24 at that position or chain section 22*a* are moving down, as shown, below the stack level, and act to actually drag down the edge of the top sheet and any curled sheets thereunder. Thus it also provides additional lead edge sheet stack settling or knockdown assistance. Furthermore, in that same portion 22*a* of the chain 22, the irregular nature of the moving chain 22 of spaced larger diameter balls 24 with smaller diameter interstices in the interconnecting elements 26 also helps to intermittently catch and pull down the sheet edges right there at the wall 12*b*, which stacking sheets have a tendency to climb up on.

At the sheet input area an upstream end section 22*b* of the highly flexible chain 22 is freely dropping generally vertically downwardly from pulley 30 irrespective of stack height. The configuration of continuously downwardly moving larger diameter beads 24 with sheet acquiring smaller diameter spaces therebetween assists in acquiring the incoming sheet lead edge and pulling that sheet down onto the top of the stack even if it has upward lead edge curl. Then the central portion 22*c* of the chain 22 freely lies flat with full weight on top of the stack. There in chain section 22*c* the intermittent and concentrated force contact areas of the spaced and generally spherical beads 24 assists in pulling the top sheet towards and into edge abutment and alignment with the wall 12*b*. The feeding normal force is provided by the independent weights of the chain elements in this portion 22*c* lying on top of the stack, and not the degree of deformation or distance from pulleys 30 and 32 (as in a flexible paddle wheel or other resilient scuffer system), and thus is relatively independent of stacking height, and thus does not require repositioning as the stack grows, and can accommodate higher stacks.

One example of a chain 22 which was been found to provide satisfactory results in the present system was a standard conventional metal bead chain of ¼ inch diameter round steel beads (approximately 6 mm), ordered from a standard hardware catalogue. Although a ball chain 22 is described herein, other loosely connected element chain-like members of suitable weight, shape and materials can be utilized. Also, the elements may be coated with suitable materials to increase their friction and/or reduce image smearing tendencies, if desired. For example, dip or spray coating urethane on the chain.

A known corrugation system may be used in cooperation with the system 20 herein so that the resultant delay in the curl down or droop of the lead edge of the sheet being restacked delays the onset of lead edge drag of the incoming sheet against the top of the stack.

If desired, the sheets may be fed into the tray 12 from the other end, over the top of the stacking assistance system 20, and allowed to drop onto the stack. In that case an angled or "uphill" inclined tray would be used. (It may be used in any case.)

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a sheet stacking apparatus for a printer or copier in which sheets are sequentially fed by sheet output means into a stacking tray and against a stacking registration wall for stacking with a sheet stacking assistance and control system; the improvement in said sheet stacking assistance and control system comprising:

an endless chain-like lose element member, supporting means providing for endless rotation of said chain-like lose element member, said supporting means for partially supporting said endless chain-like lose element member above said stacking tray so that a first integral portion of said endless chain-like lose element member hangs downwardly from said supporting means towards said stacking tray in the path of said sheets being sequentially fed by said sheet output means, and so that a second integral portion of said endless chain-like lose element member lies on top of any sheets stacking in said stacking tray, and driving means for endless rotation of said chain-like lose element member so that continuously said first portion of said chain-like lose element member is moving downwardly towards said stacking tray, and said second portion of said chain-like lose element member is being dragged over the top of any sheets stacking in said tray to drag the top sheet towards said stacking registration wall.

2. The sheet stacking control system of claim 1, wherein said supporting means for supporting said endless chain-like lose element member above said stacking tray comprises two chain supporting members spaced at opposite sides of said stacking registration wall.

3. The sheet stacking control system of claim 1, wherein said stacking tray is a copy set compiler tray.

4. The sheet stacking control system of claim 1, wherein said endless chain-like lose element member has a third integral portion dropping below one top edge of any sheets stacking in said stacking tray.

5. The sheet stacking control system of claim 1, wherein said endless chain-like lose element member has a third integral convex portion dropping below one edge of sheets stacking in said stacking tray at said stacking registration wall.

6. The sheet stacking control system of claim 1, wherein said endless chain-like lose element member has a third integral portion extending through an aperture in said stacking registration wall.

7. The sheet stacking control system of claim 1, wherein said endless chain-like lose element member has a third integral portion extending through an aperture in said stacking registration wall and dropping below the top level of one edge of any sheets stacking in said stacking tray to pull down said sheet edge.

8. The sheet stacking control system of claim 1, wherein said endless chain-like lose element member has a third integral portion downstream of said first and second portions and extending through an aperture in said stacking registration wall and dropping below one edge of sheets stacking in said stacking tray directly adjacent thereto to pull down said sheet edge, wherein said supporting means for supporting said endless chain-like lose element member above said stacking tray comprises two chain supporting members spaced at opposite sides of said stacking registration wall, and wherein said first second and third integral portions are directly sequential portions of the length of said endless chain-like lose element member hanging from said two chain supporting members.

9. The sheet stacking control system of claim 1, wherein said endless chain-like lose element member is a bead chain of multiple weighted and generally smoothly arcuately surfaced bead elements interconnected and spaced apart by highly flexible interconnecting elements of much smaller effective diameter, so as to provide concentrated and intermittent contact of said bead elements with sheets stacking in said stacking tray.

10. In a method of sheet stacking in which flimsy sheets are sequentially fed into a stacking tray to a stacking registration position for stacking with a sheet stacking assistance and control system; the improvement in said sheet stacking assistance and control system comprising:

partially supporting and rotating an endless chain-like lose element member from above the stacking tray so that a first integral portion of said endless chain-like lose element member continuously moves downwardly from said supporting means towards said stacking tray in the path of said sheets being sequentially fed into the stacking tray to help pull them down towards the stacking tray, and so that a substantial second integral portion of said endless chain-like lose element member continuously lies on top of any sheets stacking in said stacking tray and drags them towards the stacking registration position, and wherein said chain-like lose element member freely flexes in moving from said first to said second integral portions with said rotation.

11. The sheet stacking assistance and control system method of claim 10, wherein said endless chain-like lose element member is pulled through the stacking registration position and dropped below the top level of any sheets stacking in said stacking tray closely adjacent to said stacking registration position to drag down the edges of any sheets there.

12. The sheet stacking assistance and control system method of claim 10, wherein said endless chain-like lose element member is a bead chain of multiple weighted and generally smoothly arcuately surface bead elements interconnected and spaced apart by highly flexible interconnecting elements of much smaller effective diameter to provide concentrated and intermittent contact of said bead elements with sheets stacking in said stacking tray.

* * * * *